US009705245B2

(12) United States Patent
Saur et al.

(10) Patent No.: US 9,705,245 B2
(45) Date of Patent: Jul. 11, 2017

(54) PLUG-IN CONNECTION HAVING A FIXED LINE

(71) Applicant: Robert Bosch GmbH, Stuttgart (DE)

(72) Inventors: Martin Saur, Salach (DE); Markus Lux, Winnenden (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/251,159

(22) Filed: Apr. 11, 2014

(65) Prior Publication Data

US 2014/0308836 A1 Oct. 16, 2014

(30) Foreign Application Priority Data

Apr. 12, 2013 (DE) ..... 10 2013 206 558

(51) Int. Cl.

| | |
|---|---|
| ***H01R 13/627*** | (2006.01) |
| ***H01R 13/52*** | (2006.01) |
| ***H01R 4/38*** | (2006.01) |
| ***H01R 13/62*** | (2006.01) |

(52) U.S. Cl.

CPC ..... *H01R 13/627* (2013.01); *H01R 4/38* (2013.01); *H01R 13/5205* (2013.01); *H01R 13/62* (2013.01)

(58) Field of Classification Search

CPC ..... H01R 13/627; H01R 13/62; H01R 13/46; H01R 13/516; H01R 12/716; H01R 12/724; H01R 9/0518; H01R 13/5205; H01R 13/5216; H01R 43/24

USPC ..... 439/345, 576, 626, 656, 736, 725, 727, 439/942, 604

See application file for complete search history.

(56) References Cited

U.S. PATENT DOCUMENTS

| | | | | |
|---|---|---|---|---|
| 1,702,756 | A * | 2/1929 | Woodbridge | B21F 15/00 29/864 |
| 5,185,500 | A * | 2/1993 | Spinner | 174/74 R |
| 5,494,456 | A * | 2/1996 | Kozel | H01R 4/4827 439/439 |
| 6,019,637 | A * | 2/2000 | Iwata et al. | 439/595 |
| 6,257,912 | B1 * | 7/2001 | Boillot et al. | 439/329 |
| 6,332,801 | B1 * | 12/2001 | Watanbe | H01R 4/2433 439/409 |
| 6,783,385 | B2 * | 8/2004 | Rudy | H01R 4/4836 439/438 |
| 2006/0148313 | A1 * | 7/2006 | Lantto | H02K 11/00 439/541.5 |

* cited by examiner

*Primary Examiner* — Amy Cohen Johnson
*Assistant Examiner* — Oscar C Jimenez
(74) *Attorney, Agent, or Firm* — Norton Rose Fulbright US LLP; Gerard Messina

(57) ABSTRACT

A plug-in connection is described having a contact carrier including a contact element, which is mechanically connected to the contact carrier; a line has an electrical conductor, which is electrically connected to the contact element, and has an insulation which surrounds the electrical conductor. The line is mechanically connected to the contact carrier, the plug-in connection having a fixing element, into which is accommodated an uninsulated area of the line in which the electrical conductor is not surrounded by the insulation, and which fixes the electrical conductor to the contact carrier.

10 Claims, 2 Drawing Sheets

PLUG-IN CONNECTION HAVING A FIXED LINE

FIELD OF THE INVENTION

The present invention relates to a plug-in connection via which, for example, a cable harness may be connected to an electrical device.

BACKGROUND INFORMATION

A plug-in connection may include, for example, one or multiple electrical lines, the electrical conductors of which are each conductively connected to a contact element, for example, a pin socket, which may be attached to a corresponding, complementary contact element, for example, a pin.

During operation, a plug-in connection is subject to high vibration loads. Due to this vibration load, the lines are moved and may transfer this movement to the directly connected contact. This may result in a relative movement between the pin and the contact, which in turn causes wear and consequently an increase of the contact resistance. This may result in a premature failure of the plug-in connection.

A possible measure for reducing the wear-inducing line movement is to fix the line in/on or outside of (same vibration level) the plug-in connection. The fixation is made on the cable insulation. Since, however, only the insulation of the line is fixed, the cable core, i.e., the conductor, is able to continue to move in relation to the insulation. The movement of the conductor may be transferred to the contact element. This may furthermore result in a relative movement between the pin and the contact and thus in premature wear.

SUMMARY

The object of the present invention is to provide a low-wear plug-in connection.

The present invention relates to a plug-in connection, for example, a plug connector for connecting a cable harness to an electrical device. The electrical device may be, for example, a power unit or a control unit of a vehicle.

According to one specific embodiment of the present invention, the plug-in connection has a contact carrier, which has a contact element, which is mechanically connected to the contact carrier. Furthermore, the plug-in connection has a line, having an electrical conductor, which is electrically connected to the contact element, and having an insulation which surrounds the electrical conductor. The line is mechanically connected to the contact carrier in that the plug-in connection has a fixing element, into which is accommodated an uninsulated area of the line in which the electrical conductor is not surrounded by the insulation, so that the fixing element mechanically fixes the electrical conductor to the contact carrier.

In other words, the electrical conductor of the line is connected directly to the contact carrier (and not indirectly via the insulation). This makes it possible to fix the line or a cable in such a way that no line movements act upon the contact element.

The direct mechanical contact between the conductor and the contact carrier makes it possible to prevent or at least reduce a movement of the line or the conductor on the contact element. The conductor movements are thus absorbed and dissipated via the contact carrier. Thus the contact element does not move. No relative movement occurs between the contact element and the pin and consequently there is no wear.

This line fixation makes it possible to increase the vibration resistance of the plug-in connection. The wear resistance of the plug-in connection is increased with regard to vibration loads. This increases the service life of the plug-in connection, or it may be used for higher vibration requirements with no change in service life.

According to one specific embodiment of the present invention, the fixing element is designed to establish a frictional connection with the bared area. For example, the fixing element may reach around and clamp the conductor. The fixing element may have one or multiple clamping elements which clamp the electrical conductor to the contact carrier.

According to one specific embodiment of the present invention, the fixing element is designed to establish a form-fit connection with the bared area. For example, the electrical conductor may have indentations which the fixing element engages.

According to one specific embodiment of the present invention, the uninsulated area is an uninsulated end of the line. Generally, the end of the line is bare in order to connect the electrical conductor to the contact element. This end may be fixed using the fixing element on the contact carrier.

According to one specific embodiment of the present invention, the electrical conductor of the line is connected to the contact element via a separate conductor element. The conductor element may be an additional line, a flexible conductor element or a braided strip, such as a grounding strip.

According to one specific embodiment of the present invention, the conductor element is connected to the uninsulated area. The fixing element may fix the conductor element together with the uninsulated area on the contact carrier. For example, the conductor element and the electrical conductor may overlap and be clamped together into the fixing element.

According to one specific embodiment of the present invention, the contact carrier includes multiple contact elements and multiple assigned electrical lines, the electrical conductors of which are each connected at a bare area of the particular assigned electrical line to the contact carrier using a fixing element. The plug-in connection may be designed for establishing a plurality of electrical connections. In this case, multiple or all of the lines may be fixed to the shared contact carrier with the aid of a fixing element, as described herein.

According to one specific embodiment of the present invention, the electrical conductor has a litz wire bundle. The bare litz wires may be fixed between the insulated part of the line and the contact element.

According to one specific embodiment of the present invention, the contact element is designed for accommodating a pin. The contact element may include a pin socket into which the pin may be plugged.

BRIEF DESCRIPTION OF THE DRAWINGS

In principle, identical or similar components are provided with the same reference numerals.

DETAILED DESCRIPTION

Figure 1:
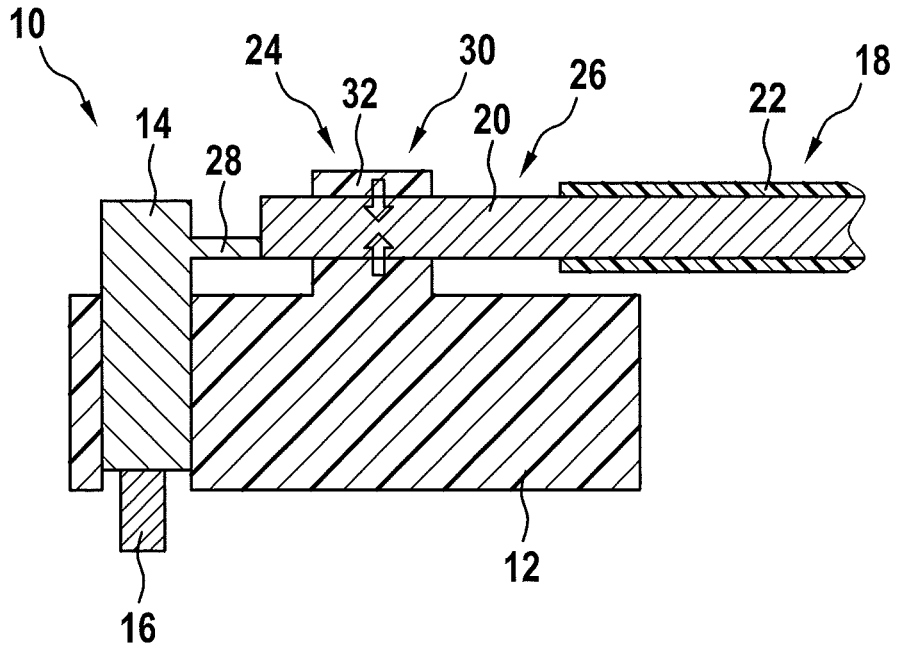
FIG. 1 shows a schematic cross section through a plug-in connection according to one specific embodiment of the present invention.
Figure 2:
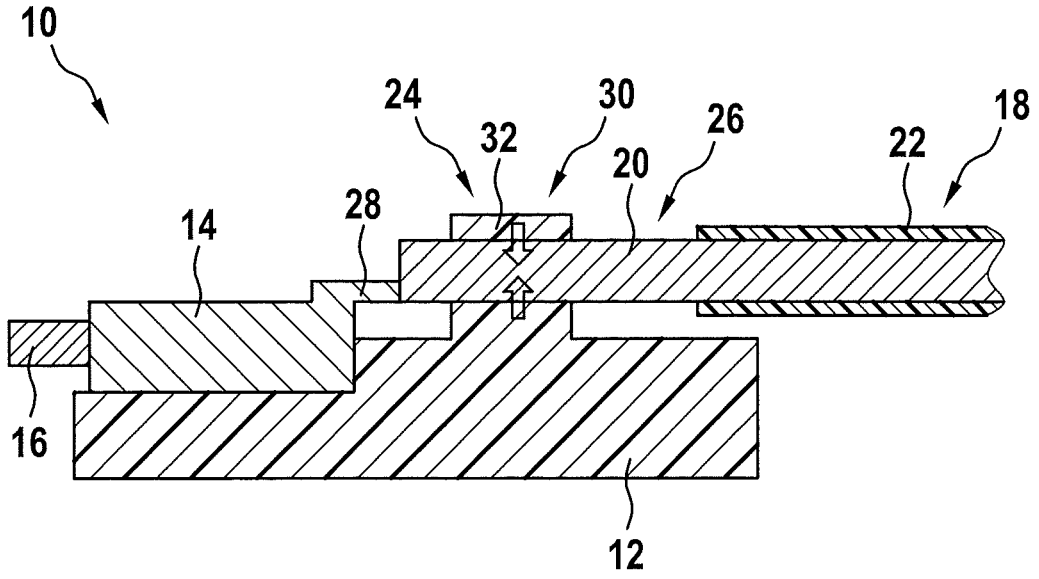
FIG. 2 shows a schematic cross section through a plug-in connection according to another specific embodiment of the present invention.

FIGS. 1 and 2 show a plug-in connection 10, which has a contact carrier 12 to which is attached a contact element 14 or a contact 14. The contact carrier may be made of a non-conductive material, such as a plastic.

Electrically conductive contact element 14 is designed to be pushed on a pin 16 and to accommodate it, in order to establish an electrical connection with pin 16. It should, however, be understood that the plug-in connection may have a pin instead of contact element 14, which may be plugged into a corresponding contact element.

Contact carrier 12 may, for example, be an integral part of a plug connector, which may be used to electrically and mechanically connect a cable harness to a power unit or a control unit of a vehicle. For example, pin 16 may be attached to a housing of the power unit or control unit.

Plug-in connection 10 of FIG. 1 has a cable outlet, which is rotated by 90° in relation to pin 16. Contact element 14 has a plug direction which runs transversely to the cable outlet.

In contrast, plug-in connection 10 of FIG. 2 has a cable outlet, which is rotated by 180° in relation to pin 16. Contact element 14 has a plug direction which runs longitudinally to the cable outlet.

Furthermore, the plug-in connection has an electrical line 18, which has an electrical conductor 20, which is surrounded by insulation 22. Electrical conductor 20 may have a single litz wire or a litz wire bundle. Electrical conductor 20 may include a grounding strip. End 24 of electrical line 18 is bare so that electrical line 18 has an area 26 which is not insulated.

Contact element 14 may be electrically connected to conductor 20 of line 18 directly, or it may be electrically connected to conductor 20 via a (flexible) conductor element 28

The plug-in connection also has a fixing element 30, which is designed for fixing or attaching uninsulated area 26 of line 18 to contact carrier 12. Fixing element 30 may, for example, have a clamping element 32, which may be used to clamp area 26, as is suggested in FIGS. 1 and 2 by arrows.

Conductor 20 of line 18 is in this way directly fixed to the contact carrier and not only indirectly via insulation 22 of line 18, which is generally made of a flexible plastic.

It should be understood that line 18 may also be fixed or attached to contact carrier 12 in the area of insulation 22.

Figure 3:
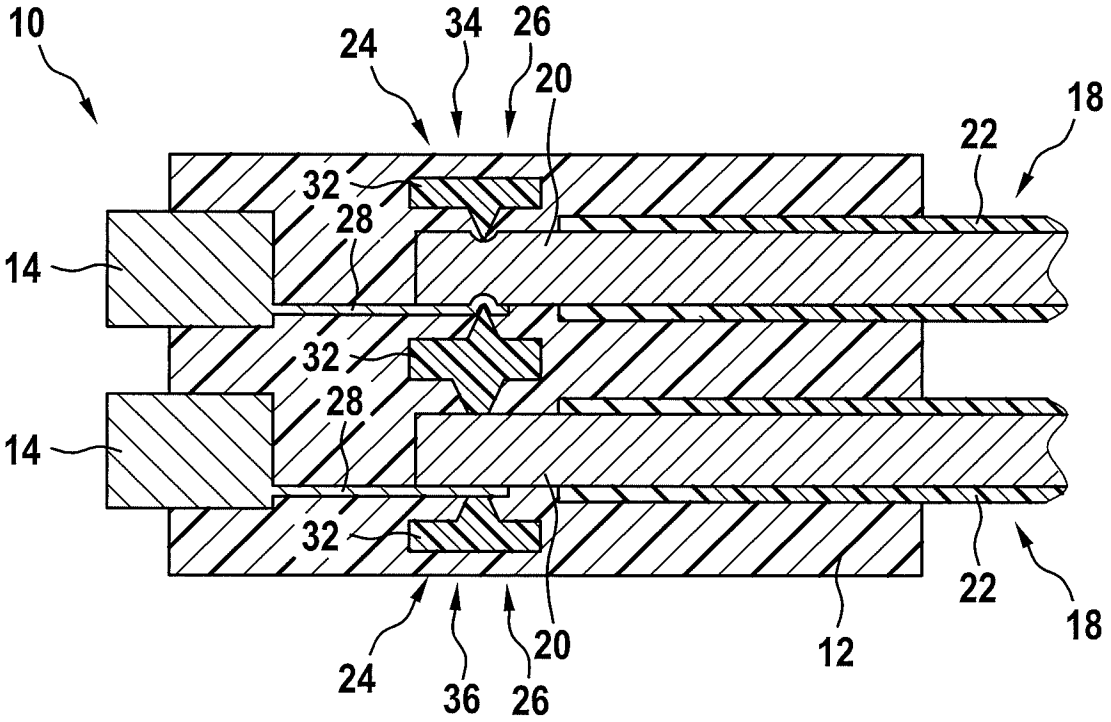
FIG. 3 shows a schematic cross section through a plug-in connection according to another embodiment of the present invention.

FIG. 3 shows that fixing element 30 may establish a form-fit connection 34 or a frictional connection 36 to conductor 20. However, a plug-in connection 10 will generally have fixing elements 30 of similar design.

Furthermore, it is shown in FIG. 3 that conductor element 28, which may be, for example, a braided strip, may be fixed to the contact carrier together with conductor 20. For example, conductor element 28 and conductor 20 overlap in area 26 and are pressed against one another there using the fixing element.

In addition, it may be pointed out that "including" does not exclude any other elements and "one" does not exclude a plurality. Furthermore, it may be pointed out that features or steps, which have been described with reference to one of the above exemplary embodiments, may also be used in combination with other features or steps of other exemplary embodiments described above.

What is claimed is:

1. A plug-in connection, comprising:

a contact carrier;

a contact element mechanically connected to the contact carrier;

a line mechanically connected to the contact carrier, wherein the line includes an electrical conductor electrically connected to the contact element, and an insulation which surrounds the electrical conductor, wherein the electrical conductor is connected to the contact element via a separate, additional conductor element, wherein the separate, additional conductor element is a flexible conductor element, and wherein the separate, additional conductor element is a braided strip; and a fixing element which is in contact with an uninsulated area of the line in which the electrical conductor is not surrounded by the insulation, and which fixes the electrical conductor to the contact carrier.

2. The plug-in connection as recited in claim 1, wherein the fixing element establishes a frictional connection with the uninsulated area.

3. The plug-in connection as recited in claim 1, wherein the fixing element establishes a form-fit connection with the uninsulated area.

4. The plug-in connection as recited in claim 1, wherein the fixing element includes a clamping element.

5. The plug-in connection as recited in claim 1, wherein the uninsulated area is an uninsulated end of the line.

6. The plug-in connection as recited in claim 1, wherein:

the conductor element is connected to the uninsulated area, and the fixing element fixes the conductor element together with the uninsulated area to the contact carrier.

7. The plug-in connection as recited in claim 1, wherein:

the contact carrier includes multiple contact elements and multiple assigned electrical lines, the electrical conductors of which are each connected at a bare area of the particular assigned electrical line to the contact carrier using the fixing element.

8. The plug-in connection as recited in claim 1, wherein the electrical conductor has a litz wire bundle.

9. The plug-in connection as recited in claim 1, wherein the contact element is structured for accommodating a pin.

10. The plug-in connection as recited in claim 1, wherein the separate, additional conductor element has a first surface that contacts the contact element and a second surface that contacts the electrical conductor.

* * * * *